US008035477B2

(12) United States Patent
Kirkjan

(10) Patent No.: US 8,035,477 B2
(45) Date of Patent: Oct. 11, 2011

(54) ENERGY-EFFICIENT ELECTRONIC ACCESS CONTROL

(76) Inventor: Gregory Paul Kirkjan, Indian Wells, CA (US)

( * ) Notice: Subject to any disclaimer, the term of this patent is extended or adjusted under 35 U.S.C. 154(b) by 1017 days.

(21) Appl. No.: 11/863,095

(22) Filed: Sep. 27, 2007

(65) Prior Publication Data

US 2009/0085717 A1 Apr. 2, 2009

(51) Int. Cl.
*G08B 21/00* (2006.01)

(52) U.S. Cl. ..... 340/5.21; 340/5.2; 340/5.61; 340/5.7; 340/5.8; 70/277; 70/278.1; 70/278.2; 70/278.3; 235/382

(58) Field of Classification Search ..... 340/5.2, 340/5.7, 5.61, 5.63, 5.8, 5.21; 70/277, 278.1, 70/278.2, 278.3; 235/382
See application file for complete search history.

(56) References Cited

U.S. PATENT DOCUMENTS

| | | | | |
|---|---|---|---|---|
| 3,733,862 | A | 5/1973 | Killmeyer | |
| 4,144,523 | A | 3/1979 | Kaplit | |
| 4,157,534 | A | 6/1979 | Schachter | |
| 4,326,124 | A | 4/1982 | Faude | |
| 4,562,712 | A | 1/1986 | Wolter | |
| 4,663,952 | A | 5/1987 | Gelhard | |
| 4,686,358 | A | 8/1987 | Seckinger et al. | |
| 4,713,660 | A | 12/1987 | Camenzind | |
| 4,833,465 | A | 5/1989 | Abend et al. | |
| 5,089,692 | A | 2/1992 | Tonnesson | |
| 5,140,317 | A * | 8/1992 | Hyatt et al. | 340/5.25 |
| 5,198,643 | A | 3/1993 | Miron et al. | |
| 5,245,329 | A | 9/1993 | Gokcebay | |
| 5,477,041 | A | 12/1995 | Miron et al. | |
| 5,493,882 | A * | 2/1996 | Jasper | 70/278.4 |
| 5,905,446 | A * | 5/1999 | Benore et al. | 340/5.7 |
| 6,046,558 | A | 4/2000 | Larson et al. | |
| 6,382,003 | B1 | 5/2002 | Watanuki et al. | |
| 6,900,720 | B2 | 5/2005 | Denison et al. | |
| 6,965,295 | B2 * | 11/2005 | Shimonomoto et al. | 340/5.61 |
| 6,980,672 | B2 | 12/2005 | Saito et al. | |
| 7,009,489 | B2 | 3/2006 | Fisher | |
| 7,009,490 | B2 | 3/2006 | Wong | |
| 2003/0122651 | A1 | 7/2003 | Doi et al. | |
| 2005/0051621 | A1 | 3/2005 | Wong et al. | |
| 2006/0176146 | A1 * | 8/2006 | Krishan et al. | 340/5.53 |
| 2006/0192653 | A1 * | 8/2006 | Atkinson et al. | 340/5.61 |

* cited by examiner

*Primary Examiner* — Jennifer Mehmood
*Assistant Examiner* — Mark Rushing
(74) *Attorney, Agent, or Firm* — Knobbe Martens Olson & Bear, LLP

(57) ABSTRACT

An embodiment of an electronic access control system includes an electronic key, an electronic lock, and an access control administration program. The electronic key can include program code for switching between a lock mode and a computer mode. In some embodiments, the lock mode and computer mode allow for simplified administration and operation of the access control system. Some embodiments of the electronic key include a rechargeable battery. In some embodiments, the access control system includes a hybrid power supply system having a rechargeable battery and a generator. In some embodiments, the electronic lock includes a piezoelectric latch. In some embodiments, the electronic key is configured to act as a storage device for a computer system. Some embodiments provide an electronic access control system with a streamlined user interface.

27 Claims, 10 Drawing Sheets

FIG. 10

1000

Key Users In Domain
(gregsdomain.mky) 1002

Add Key Main Menu

| Key Alias Name | Key_ID# | Key Type | |
|---|---|---|---|
| Greg K | KABCD12344 | Master | X |
| Joe S | KABCD12345 | Slave | X |
| John L | KABCD12346 | Slave | X |
| Alice S | KABCD12347 | Slave | X |
| | | | |

Locks In Domain
(gregsdomain.mky) 1004

Add Lock to Domain Main Menu

| Lock Alias Name | Lock_ID# | Access Log | |
|---|---|---|---|
| Front Door | KL00-ABCD-9876 | --- | X |
| Closet | DL10-ABCD-9877 | --- | X |
| Gate#1 | DL10-ABCD-9878 | Download | X |
| Gate#2 | UL10-ABCD-9880 | Download | X |
| | | | |

Edit Lock Key Access Information
(KL00-ABCD-9876.lck) 1006

Add Key User Update Lock File Main Menu

| Front Door | | |
|---|---|---|
| Key Alias Name | Key Type | |
| Greg K | Master | X |
| Joe S | Slave | X |
| John L | Slave | X |
| | | |

Revision: 04-01-2007 10:00am

Edit Lock Key Access Information
(DL10-ABCD-9877.lck) 1008

Add Key User Update Lock File Main Menu

| Closet | | |
|---|---|---|
| Key Alias Name | Key Type | |
| Greg K | Master | X |
| Joe S | Slave | X |
| John L | Slave | X |
| Alice S | Slave | X |
| | | |

Revision: 03-15-2006 11:00pm

ENERGY-EFFICIENT ELECTRONIC ACCESS CONTROL

BACKGROUND

1. Field of the Disclosure

This disclosure relates to the field of electronic access control and, more particularly, to electronic access control systems and methods that provide for improved energy efficiency.

2. Description of the Related Art

Lock and key sets are used in a variety of applications, such as in securing file cabinets, facilities, safes, equipment, and the like. Some traditional mechanical lock and key sets can be operated without the use of electrical energy. However, mechanical access control systems and methods can be costly and cumbersome to administer. For example, an administrator of a mechanical access control system may need to physically replace several locks and keys in a system if one or more keys cannot be accounted for.

Electronic lock and key systems have also been used for several years, and some have proven to be reliable mechanisms for access control. Electronic access control systems can include an electronic key that is configured to connect to a locking mechanism via a key interface. In at least some electronic access control systems, the electronic key can be used to operate the locking mechanism via the key interface. Existing electronic access control systems suffer from various drawbacks.

SUMMARY

An object of some embodiments disclosed herein is to provide an electronic key that is capable of functioning as a storage device for digital files. Furthermore, some embodiments provide an electronic key configured to function as a memory card reader. Some electronic key embodiments provide a single connector that interfaces with both an electronic lock and a computer system. Some embodiments provide an energy-efficient technique for operating an electronic locking mechanism. Some electronic lock embodiments include a low power electronic latch that secures a bolt. Some embodiments disclosed herein provide an improved electronic locking system that provides a convenient way to charge a power source for the locking system. Some embodiments disclosed herein provide an electronic locking system that employs user-supplied mechanical force to generate power to operate an electronic lock and/or to operate an electronic key.

An object of some embodiments is to provide for easier administration of an electronic access control system. An object of some embodiments is to provide an electronic access system that provides for simplified electronic lock operation by using program logic to evaluate one or more criteria, conditions, or events. Some embodiments enable an access control system administrator to replace existing locks in doors, pad locks, or locks in remote locations with electronic locks that do not require a wired electrical connection in order for the lock to be powered. Some embodiments enable a single electronic key to replace multiple mechanical keys.

One embodiment provides a rechargeable electronic key for use with an electronic lock. The electronic key includes a memory device; a private identifier for the electronic key stored in the memory device, the private identifier being accessible to the electronic lock but not readily accessible to a user of the electronic key; a key controller configured to electrically connect to a lock controller associated with the electronic lock; a power management circuit configured to electrically connect to a power source; and a rechargeable battery. The power management circuit is configured to supply energy from the rechargeable battery to other components of the electronic key, to supply energy from the rechargeable battery to the electronic lock when the electronic key is engaged with the electronic lock, and to recharge the rechargeable battery when the power management circuit is connected to the power source.

In another embodiment, an electronic access control system is provided. The electronic access control system includes an electronic lock and an electronic key. The electronic lock includes a bolt; a lock memory; key access information stored in the lock memory; a key connector; and a piezoelectric latch configured to secure the bolt in a fixed position when the piezoelectric latch is in a first state and to allow the bolt to move between a locked position and an unlocked position when the piezoelectric latch is in a second state. The electronic key includes a key memory; a private identifier stored in the key memory, the private identifier being accessible to the electronic lock but not readily accessible to a user of the electronic access control system; a lock connector disposed on the key housing, the lock connector being configured to electrically connect to the key connector of the electronic lock; and a battery. The battery is configured to provide energy to actuate the piezoelectric latch between the first state and the second state when the lock connector of the electronic key is inserted into the key connector of the electronic lock, if it is determined that the private identifier, or the public and private identifiers, is present in the key access information stored in the lock memory.

In another embodiment, an electronic access control system having switchable power states is provided. The electronic access control system includes an electronic key. The electronic key includes a key housing; a first connector disposed on the key housing, the connector having a key power supply pin and a key ground pin, and the first connector being configured to electrically connect to a digital bus associated with the electronic lock; a microcontroller; a battery; and a switching device connected between the battery and the power supply pin of the first connector and configured to allow energy to flow from the battery to the power supply pin of the first connector when the electric potential on the first connector side of switching device is less than the electric potential on the battery side of the switching device. In some embodiments, the electronic access control system includes an electronic lock. The electronic lock can include a lock chassis; a lock controller; and a second connector having a lock ground pin. The lock ground pin is electrically connected to the lock chassis, and the second connector is configured to electrically connect to the first connector. The key ground pin is isolated from ground when the first connector is not connected to the second connector. The key ground pin connects to the lock chassis, and the battery of the electronic key supplies electrical energy to the electronic access control system, when the first connector is connected to the second connector.

In yet another embodiment, an electronic access control system is provided. The electronic access control system includes an electronic lock and an electronic key. The electronic lock includes a lock chassis; a lock controller with nonvolatile memory; and a lock USB connector having a lock ground pin and a lock power supply pin. The lock ground pin is connected to the lock chassis. The electronic key includes a key controller; a key memory; a public identifier stored in the key memory, the public identifier being readily accessible to a user of the electronic access control system; a private identifier stored in the key memory, the private identifier being accessible to the electronic lock but not readily accessible to a user of the electronic access control system; a key USB connector disposed on the key housing, the key USB connector having a key power supply pin and a key ground pin, and the key USB connector being configured to electrically connect to the lock USB connector of the electronic lock; and a circuit comprising a battery and a diode connected between the battery and the key power supply pin. The key ground pin is isolated from the key USB connector such that, when the key USB connector is inserted into the lock USB connector, the key ground pin connects to the lock USB chassis and the battery of the electronic key supplies energy to the electronic access control system.

A further embodiment provides an electronic lock that generates electrical energy for the electronic lock and an electronic key. The electronic lock includes a lock memory; key access information stored in the lock memory; a key connector having a power supply pin; a generator configured to be driven by movement of the electronic key when the electronic key is used in the key connector; a lock circuit; and a latch electrically connected to the lock circuit, the latch being configured to actuate between a locked state and an unlocked state when an identifier associated with the electronic key is present in the key access information stored in the lock memory. The generator is configured to at least partially power the lock circuit and the electronic key.

In a further embodiment, an electronic key for use with an electronic lock and for storing digital files is provided. The electronic key includes a key memory; a private identifier for the electronic key, the private identifier being accessible to the electronic lock but not readily accessible to the user of the electronic key; a digital bus connector, the digital bus connector being configured to electrically connect to a digital bus associated with the electronic lock, and the digital bus connector being configured to electrically connect to a digital bus associated with a computer system having a microprocessor, a main memory, and an operating system; and a microcontroller configured to allow the computer system to access the key memory as a mass storage device.

An additional embodiment provides an electronic key for use with an electronic lock. The electronic key includes a socket for a solid state non-volatile memory device; a microcontroller having a non-volatile memory; a public identifier for the electronic key stored in the non-volatile memory of the microcontroller, the public identifier being readily accessible to a user of the electronic key; a private identifier for the electronic key stored in the non-volatile memory of the microcontroller, the private identifier being accessible to the electronic lock but not readily accessible to the user of the electronic key; and a digital bus connector disposed on the key housing, the digital bus connector being configured to electrically connect to a digital bus associated with the electronic lock.

In an embodiment, an electronic access control system with a streamlined user interface is provided. The electronic access control system includes an electronic lock, a first electronic key, and a second electronic key. The electronic lock includes a lock memory configured to store key access information; a lock identifier; a lock controller comprising program code for comparing a key identifier to the key access information stored in the lock memory; and a lock bus connector. The first electronic key includes a first memory device; a lock configuration file comprising key access information for configuring the electronic lock; a first private identifier for the first electronic key, the first private identifier being accessible to the lock controller but not readily accessible to a user of the first electronic key; a first key controller comprising program code for providing key access information to the electronic lock when first predetermined criteria are met, program code for accessing the electronic lock when second predetermined criteria are met, and program code for erasing the electronic lock when third predetermined criteria are met; and a first digital bus connector configured to electrically connect to the lock bus connector. The second electronic key includes a second memory device; a second private identifier for the second electronic key, the second private identifier being accessible to the lock controller but not readily accessible to a user of the second electronic key; a second key controller comprising program code for accessing the electronic lock without user input when fourth predetermined criteria are met; and a second digital bus connector configured to electrically connect to the lock bus connector.

For purposes of summarizing the invention, certain aspects, advantages and novel features have been described herein. Of course, it is to be understood that not necessarily all such aspects, advantages or features will be embodied in any particular embodiment. Moreover, it is to be understood that not necessarily all such advantages or benefits may be achieved in accordance with any particular embodiment of the invention. Thus, for example, those skilled in the art will recognize that the invention may be embodied or carried out in a manner that achieves one advantage or group of advantages as taught herein without necessarily achieving other advantages or benefits as may be taught or suggested herein.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention. Throughout the drawings, reference numbers are reused to indicate correspondence between referenced elements.

FIG. 10 illustrates an embodiment of an interface for configuring key access information.

DETAILED DESCRIPTION OF PREFERRED EMBODIMENTS

Figure 1:
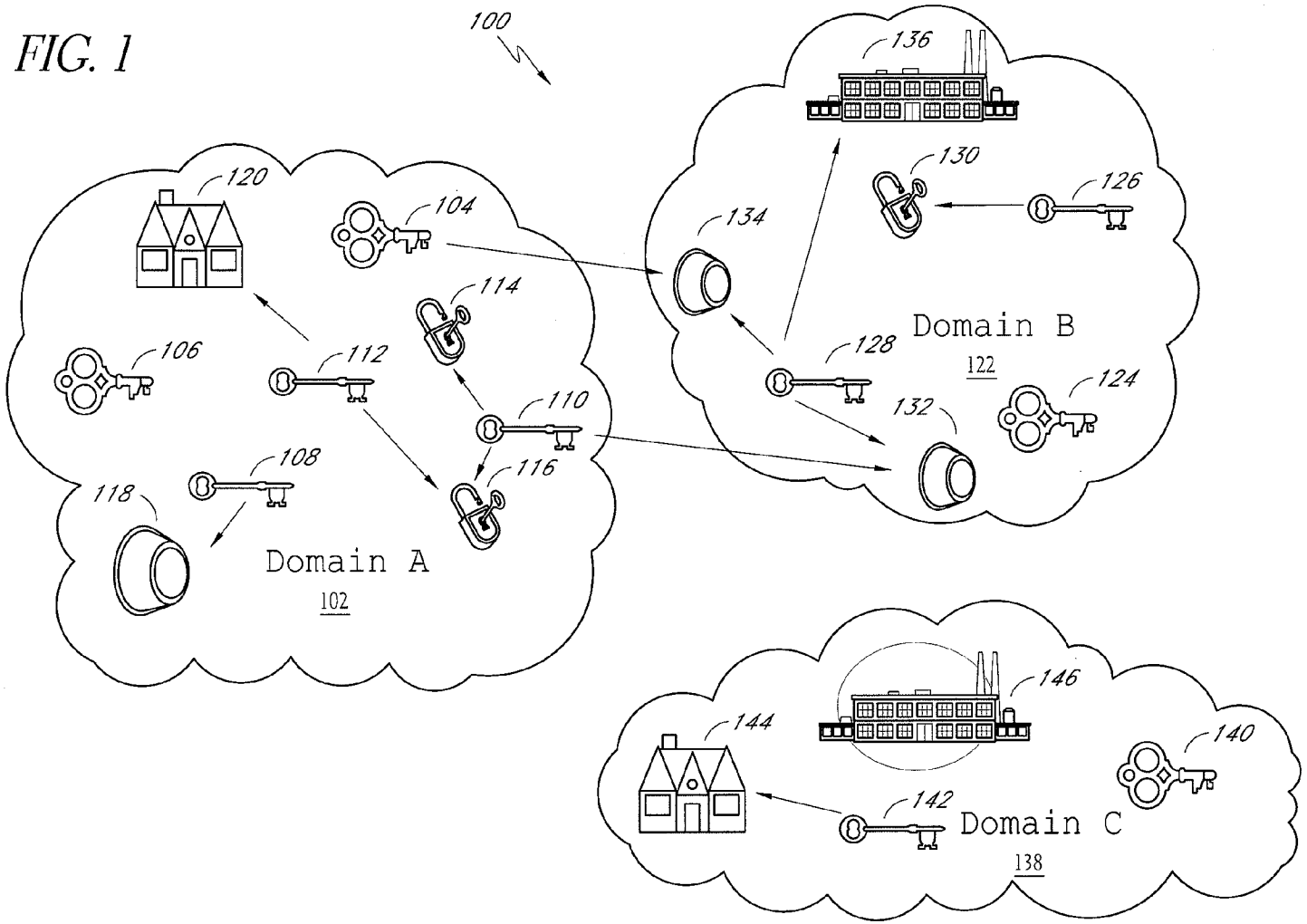
FIG. 1 illustrates an example embodiment of an access control system subdivided into domains.

Systems and methods which represent various embodiments and example applications of the present disclosure will now be described with reference to the drawings.

For purposes of illustration, some embodiments are described in the context of access control systems and methods incorporating a type of Universal Serial Bus (USB) connection. The USB connection can be configured to comply with one or more USB specifications created by the USB Implementers Forum, such as, for example, USB 1.0, USB 1.1, USB 2.0, USB On-The-Go, Inter-Chip USB, MicroUSB, USB Battery Charging Specification, and so forth. The present invention is not limited by the type of connection which the systems and methods employ. At least some of the systems and methods may be used with other connections, such as, for example, an IEEE 1394 interface, a serial bus interface, a parallel bus interface, a magnetic interface, a radio frequency interface, a wireless interface, a custom interface, and so forth. At least some of the figures and descriptions, however, relate to embodiments using a USB interface. The system may include a variety of uses, including but not limited to access control for buildings, equipment, file cabinets, safes, doors, padlocks, etc. It is also recognized that in other embodiments, the systems and methods may be implemented as a single module and/or implemented in conjunction with a variety of other modules. Moreover, the specific implementations described herein are set forth in order to illustrate, and not to limit, the invention. The scope of the invention is defined by the appended claims.

The access control system as contemplated by at least some embodiments generally includes an electronic lock and an electronic key. The electronic lock and the electronic key are configured to communicate with each other via an interface. The electronic lock can include, for example, a bolt, an electronic latch, nonvolatile memory, a key interface or connector, a microcontroller, a generator, one or more gears, a switching regulator, lock configuration information, key access information, an access log, program modules, other mechanical components, and/or other circuits. In some embodiments, the electronic latch includes, for example, a piezoelectric latch or another type of energy-efficient latch or actuator. Two or more functional components of the lock can optionally be integrated into a single physical component. For example, the memory of the lock may be embedded on the same integrated circuit as the microcontroller.

In some embodiments, the electronic key can include, for example, a key housing, a memory device, one or more key identifiers, lock configuration files containing key access information for a lock, a microcontroller, a lock interface or connector, a power source, a memory card slot, program modules, other mechanical components, and/or other circuits. Some embodiments of the electronic key can also include a battery, a battery charger, a digital bus connector, circuitry to detect when the electronic key is connected to another device, a second memory integrated with the microcontroller, a storage device controller, a file system, and/or program logic for determining what actions perform in response to conditions or events.

In some embodiments, the access control system includes an application program for creating a domain file and/or lock configuration files that can be stored on a computer or on electronic keys. In some embodiments, the access control system can be subdivided into domains so that key access information for groups of electronic locks and keys to be managed more efficiently. For example, a domain file can include access control information for all locks and keys in a domain, while a lock configuration file can contain access control information for a single lock in the domain.

FIG. 1 illustrates an example embodiment of an access control system 100 subdivided into three domains 102, 122, 138. A first domain 102 of the access control system 100 includes locks 114, 116, 118, 120 associated with a first controlled access environment, such as, for example, a residence. The locks 114, 116, 118, 120 can include, for example, pad locks, door locks, cabinet locks, equipments locks, or other types of locks. In the embodiment shown in FIG. 1, the first domain 102 includes master keys 104, 106. Master keys have privileges to perform administrative functions on the locks in a domain. For example, in some embodiments, master keys can access, erase, program, or reprogram locks in a domain. Thus, the master keys 104, 106 in the first domain 102 are able to perform any of the master key functions on the locks 114, 116, 118, 120 in the first domain 102. Master keys can also have privileges to access locks in other domains. For example, a master key 104 in the first domain 102 can access a lock 134 in the second domain 122. However, in the embodiment shown in FIG. 1, the master key 104 does not have administrative privileges in the second domain 122 and cannot erase, program, or reprogram the lock 134 in the second domain 122.

In the embodiment shown in FIG. 1, the first domain 102 also includes slave keys 108, 110, 112. Slave keys can have privileges to access one or more locks in a domain but do not have privileges to perform all the administrative functions that master keys can perform. In some embodiments, an access control system administrator can set up a domain such that slave keys have access to only a portion of the locks in a domain. A slave key 110 can also have access privileges to locks 114, 116, 132 in multiple domains 102, 122.

A second domain 122 of the access control system 100 includes locks 130, 132, 134, 136 associated with a second controlled access environment, such as, for example, a workplace. The second domain 122 includes a master key 124 that has administrative privileges for all of the locks 130, 132, 134, 136 in the second domain 122. The second domain 122 also includes slave keys 126, 128 that have access privileges to some of the locks. Keys in the access control system 100 illustrated in FIG. 1 can belong to more than one domain. A third domain 138 includes a master key 140 that has administrative privileges for locks 144, 146 in the domain. The third domain 138 also includes a slave key 142 that has access privileges for a lock 144 in the domain 138. The third domain 138 is an example of a domain in which the master key 140 and the slave key 142 have no access or administrative privileges outside the domain 138.

In some embodiments, each of the domains 102, 122, 138 is associated with a domain file. The domain file can contain information associated with a domain of the access control system 100, including, for example, key users and locks in a domain. One or more lock configuration files can also be associated with each domain. In some embodiments, a lock configuration file contains key access information associated with an electronic lock. An example interface 1000 for modifying such information is shown in FIG. 10. The domain file can be created or modified by an access control administration application program (an "admin application"). In some embodiments, the domain file can be stored on a master key, on a computer, or on both. In some embodiments, master keys have administrative privileges only in the domains in which they are assigned. Master keys and slave keys can have access privileges for locks in any domain. A domain file can be password protected to increase the security of an access control system. In some embodiments, a person possessing a master key is allowed to use the admin application to modify the domain file and lock configuration files on the master key. For example, the person could reconfigure the domain file and lock configuration files to remove other master keys from the domain. However, in some embodiments, a person must also know a domain password in order to be able to modify the domain file and lock configuration files.

Figure 2:
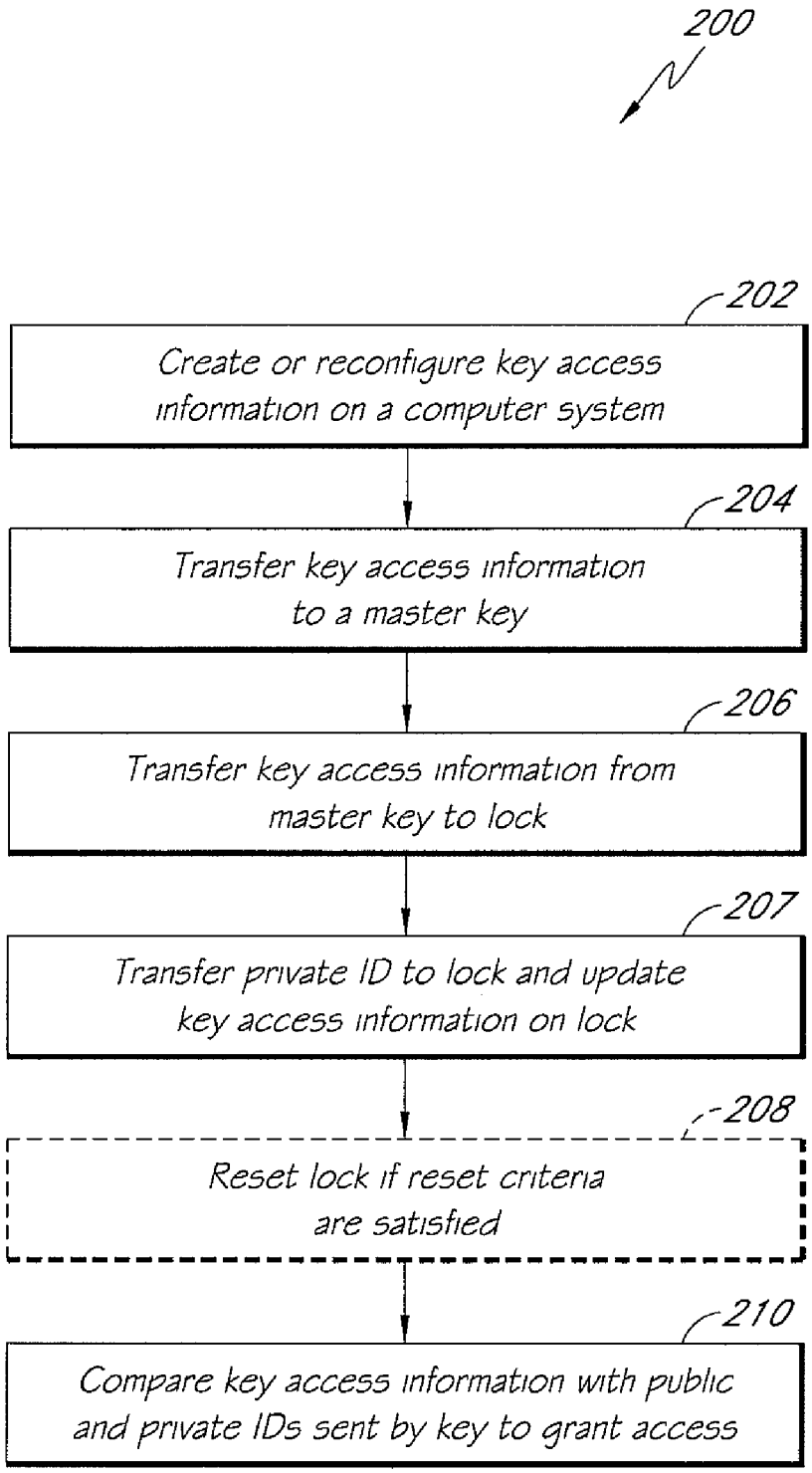
FIG. 2 is a flowchart of an embodiment of a method for configuring and operating an access control system.

The flowchart in FIG. 2 shows of an embodiment of a method 200 for configuring and operating an access control system. The method 200 includes creating or reconfiguring key access information (202). In some embodiments, an administrator uses an admin application on a computer to create or reconfigure a domain with one or more master key public identifiers, slave key public identifiers, and lock identifiers. The public identifier of a lock or key can be readily available to a person. For example, the public identifier can be printed on the lock or key, or it may be visible in some other way. The key access information for a lock can be stored, for example, in a lock configuration file. In some embodiments, a domain file links the lock configuration file to a lock (for example, to an alias of the lock) and associates one or more keys with a user name or alias. The admin application can be configured to translate or interpret lock aliases and key aliases into identifiers associated with the locks and keys, respectively. The name of the domain file may correspond with the name of the domain. In some embodiments, the name of the domain can be changed by renaming the domain file.

In the embodiment shown in FIG. 2, a newly created or reconfigured lock configuration file is transferred to a master key (204). In some embodiments, a user connects the master key to a computer, and the user causes the computer to copy one or more lock configuration files containing the key access information for the domain to a memory on the master key or keys associated with the domain. In alternative embodiments, the copying process can be handled by the admin application. In some embodiments, a user of the computer can also copy other files to the memory of the key while it is connected to the computer. For example, the user may copy her digital music collection, digital photos, digital videos, or digital documents onto the key.

After the lock configuration files containing key access information are transferred to the master key, the master key can be used to program locks in the domain of the master key (206). For example, in some embodiments, the master key can be configured to program or reprogram a lock when a public identifier and a private identifier of the master key match identifiers contained in the key access information stored on the lock, when a lock identifier matches the file name of a lock configuration file on the master key, and when a connector on the master key is inserted into the lock. A private identifier of the master key can also be copied to the lock at the time that the lock is programmed or at some earlier time. The private identifier is not visible to a person and is not available to the admin application. In some embodiments, when a slave key with a public identifier present in the key access information of a lock is inserted into the lock after the lock has been programmed, the slave key copies a private identifier for the slave key to the lock (207). The lock adds the private identifiers of the keys that have access privileges to the key access information stored in the lock when the keys are first inserted into the lock, after the lock is programmed or reprogrammed.

In some embodiments, a lock in a domain can be configured to update its key access information when a master key for the domain is inserted into the lock and when the master key has a more recent revision of the key access information contained in the lock configuration file. For example, if a first master key in a domain is updated by the admin application but a second master key in the domain does not, then the first master key will update locks with new key access information while the second master key will not be allowed to reprogram the locks in the domain with the old key access information until the second master key is updated with newer key access information.

In some embodiments, a master key may be allowed to include key access information for more than one domain. In some embodiments, the admin application is configured such that it does not allow a lock to be present in different domains on the same master key.

In some embodiments, the lock is optionally configured to reset when certain criteria (such as, for example, predetermined criteria) are satisfied (208). In some embodiments, master keys in a domain have lock erase privileges for locks in the domain. In some embodiments, a master key can be configured to erase key access information from a lock when the master key is inserted into the lock after key access information is deleted using the admin application from the lock configuration file on the master key. In some embodiments, an administrator can use the admin application to remove all key access privileges from a lock configuration file. In some embodiments, if the lock configuration file associated with a lock is deleted from a master key, then the lock treats the master key as a slave key. As long as the lock configuration file is missing, the lock grants the master key access privileges only. This can reduce the risk of unintentionally erasing a lock if files are erased mistakenly.

In the embodiment shown in FIG. 2, after collecting private identifiers from the keys in the domain, the lock is set up to provide access when one of the master or slave keys is inserted into the lock (210). For example, the public identifier in the key access information on the lock can be compared with the public identifier sent by the key. In some embodiments, the lock determines whether the private identifier of a key is present in key access information stored in the memory of the lock. In some embodiments, if the private identifier is present in the lock memory, the lock actuates an electronic latch to provide access. In some embodiments, an administrator of the access control system accesses the locks in a domain with each of the keys in the domain after reconfiguring or creating a domain file and the lock configuration files.

In some embodiments, locks are programmed during manufacturing with an identifier (such as, for example, a public identifier). Master keys and slave keys can be programmed during manufacturing with a public identifier and a private identifier. The private identifier can be configured to be inaccessible to the admin application and to persons in order to increase the security of the access control system.

Figure 3A:
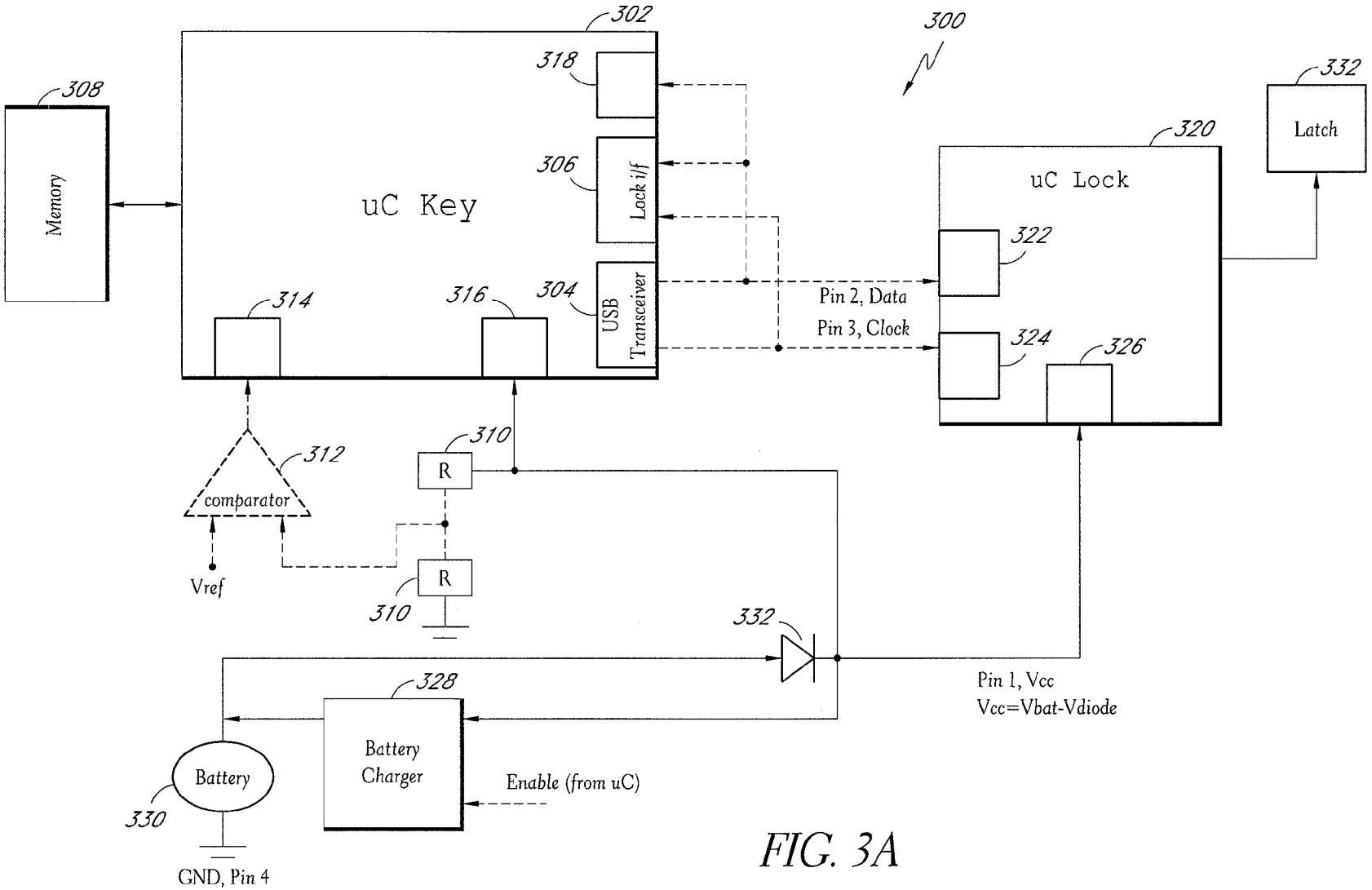
FIG. 3A is a detailed block diagram of an embodiment of an electronic lock connected to an electronic key that includes a rechargeable battery.
Figure 3B:
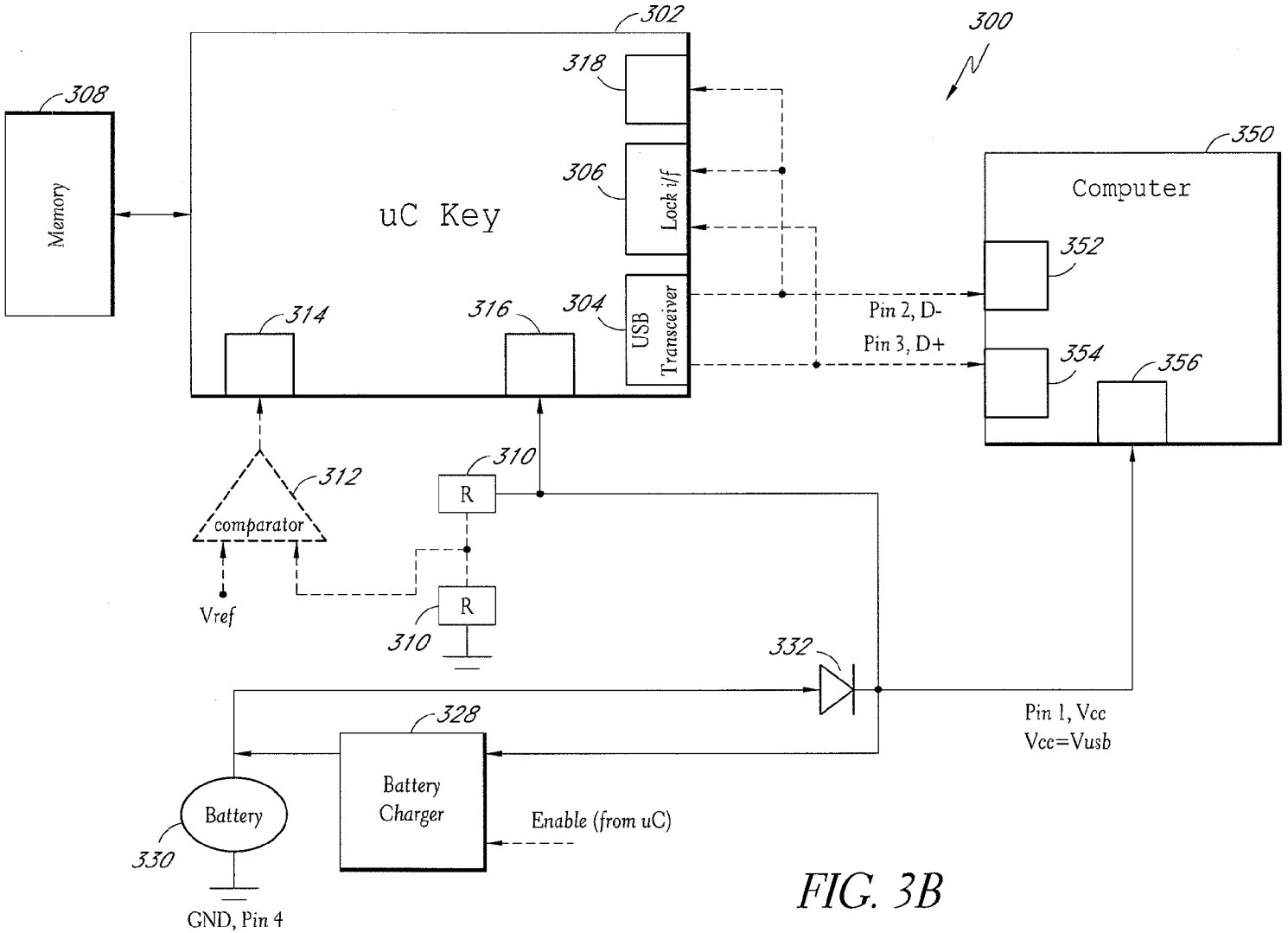
FIG. 3B is a detailed block diagram of an embodiment of a computer connected to an electronic key that includes a rechargeable battery.

FIG. 3A is a detailed block diagram of an embodiment of an electronic lock and key system 300 having a rechargeable battery 330. In some embodiments, at least some of the electronic key components shown in FIGS. 3A and 3B are powered even when the key is not connected to a computer or an electronic lock. The electronic key can include a key microcontroller 302 that is connected to a memory 308. The microcontroller 302 can include any suitable design, including a design that integrates a USB transceiver, a comparator, a voltage reference, and/or a voltage regulator. For example, a microcontroller selected from the SiLabs C8051F34X family of microcontrollers, available from Silicon Laboratories of Austin, Tex., may be used. The memory 308 can be a non-volatile memory device, such as NAND flash memory. The memory 308 can also include a memory card or other removable solid state media such as, for example, a Secure Digital card, a micro Secure Digital card, etc. The microcontroller 302 can also have an optional integrated memory (not shown).

In the embodiment shown in FIG. 3A, the microcontroller 302 includes a USB transceiver 304, a lock interface 306, interrupts 314, 318, and an electrical input 316. The microcontroller 302 forms part of a circuit that can include a comparator 312, a diode 332, a battery charger 328, a battery 330, and other circuit components such as resistors 310, a ground plane, pathways of a lock connector, and other pathways. In some embodiments, the lock connector has four pathways or pins: a power supply pin (Pin 1), a data pin (Pin 2), a clock pin (Pin 3), and a ground pin (Pin 4). In lock mode, there can be separate clock and data signals; however, the clock and data can also share the pins on the connector when a four pin connector is used.

The battery 330 can be any suitable rechargeable battery, such as, for example, a lithium-ion battery, and can be configured to provide a suitable electric potential, such as, for example, 3.7 volts. The battery 330 is placed between a ground, such as Pin 4 of the USB connector, and a diode 332. The electronic key can also include a detection circuit. For example, a reference integrated circuit or a Zener diode derived from the power bus feeding 316 (or Pin 1) can be provided to a reference input for comparator 312. The diode 332 can be, for example, a Schottky diode, an energy efficient diode, or another type of diode. In some embodiments, another type of switching device can be used in place of the diode 332. The diode 332 is oriented to allow current to flow from the battery 330 to Pin 1 of the USB connector. Pin 1 of the USB connector is also connected to the electrical input 316 of the microcontroller 302, an input of the comparator 312 (for example, through a voltage splitter circuit including resistors 310 and a connection to ground), and the battery charger 328. The output of the detection circuit (for example, the output of the comparator 312) can be connected to a computer mode interrupt or reset 314 of the key microcontroller.

In the embodiment shown in FIG. 3A, the electronic key is connected to an electronic lock via an external lock connector, such as, for example, a physical connector that is compatible with a USB connector. The electronic lock includes a lock microcontroller 320 and an electronic latch 332. The microcontroller 320 includes a data interface 322, a clock interface 324, and an electrical power interface 326. The data interface 322 connects to Pin 2 of the USB connector, which is connected to the USB transceiver, the lock interface 306, and a lock mode interrupt 318 when the key connector is inserted into the lock connector. In some embodiments, a data signal on Pin 2 sent by lock microcontroller 320 via data interface 322 will trigger the lock mode interrupt or reset 318 of the key microcontroller 302, causing the microcontroller to enter a lock connection mode. When in the lock connection mode, the key microcontroller 302 can communicate with the lock microcontroller 320 via the lock interface 306, and the USB transceiver 304 can be inactive or disabled. When certain criteria are satisfied, the lock microcontroller 320 can perform various operations, such as, for example, erasing a lock memory (not shown), replacing the key access information stored in the lock memory, or opening the lock by causing the latch 332 to actuate. In some embodiments, the latch 332 is a piezoelectric latch or another style of latch or actuator that permits a relatively small amount of energy to actuate the latch. For example, the latch 332 may include a Servocell AL1a actuator available from Servocell Ltd. of Harlow, Essex, UK, an energy efficient latch that consumes less than about 1.2 mW, or another suitable variety of latch or actuator.

When the USB connector on the key is plugged into a lock, Pin 1 of the USB connector attaches to the electrical power interface 326 of the lock. In this state, the electric potential on Pin 1 is substantially equal to the electric potential of a terminal of the battery 330 less any voltage drop across the diode 332, and the diode 332 is closed or "on." The battery 330 provides power to both the electronic key and the electronic lock. Pin 3 of the USB connector attaches to the clock signal generated by the lock microcontroller 320 and/or clock interface 324. The clock signal is routed from a pin on a lock interface 306, for example, to assist in data communications between the lock and key. In some embodiments, when the electronic key is connected to a lock, a USB transceiver 304 is disabled on the key microcontroller 302. However, the USB transceiver 304 can share data and/or clock pins with the lock interface module to decrease connector pin count and to allow a USB connector to be used for both connections.

FIG. 3B shows a detailed block diagram of an embodiment of a computer 350 connected to an electronic key that includes a rechargeable battery 330. The computer 350 can be, for example, a device containing a host USB interface, a desktop computer, a notebook computer, a handheld computer, a mobile phone, or another type of computing device. When Pin 1 of the USB connector is connected to a powered USB pin 356 (for example, on a computer 350 or on a USB charging device, not shown), the electric potential on Pin 1 is higher than the electric potential at the battery 330 terminal, the output of the comparator 312 changes, and the diode 332 is open or "off." In this state, the electric potential on Pin 1 is substantially equal to the electric potential supplied by a powered USB bus when the USB connector is plugged into a computer. The output change of comparator 312 will trigger the computer mode interrupt or reset 314 of the key microcontroller 302. The microcontroller 302 will enter a computer connection mode.

In computer connection mode, the USB transceiver 304 can be enabled and the lock interface 306 can be inactive or disabled. In some embodiments, the USB connector has four pathways or pins: a power supply pin (Pin 1), a data with clock recovery pin (Pin 2), a data and clock pin (Pin 3), and a ground pin (Pin 4). The D-pin (Pin 2) and D+pin (Pin 3) are used to transmit differential data signals with encoding that the USB transceivers use to recover a clock. The computer can supply USB data with clock recovery encoding via pins 352, 354 of the computer's USB interface. The USB transceiver 304 can assist in communications between the key and the computer 350. In some embodiments, the microcontroller 302 provides instructions to the battery charger 328 for charging the battery 330 while in the computer connection mode. For example, the battery charger 328 can be a Linear Tech LTC4065L from Linear Technology of Milpitas, Calif., a battery charger for a lithium ion battery, or another suitable battery charger.

Figure 4B:
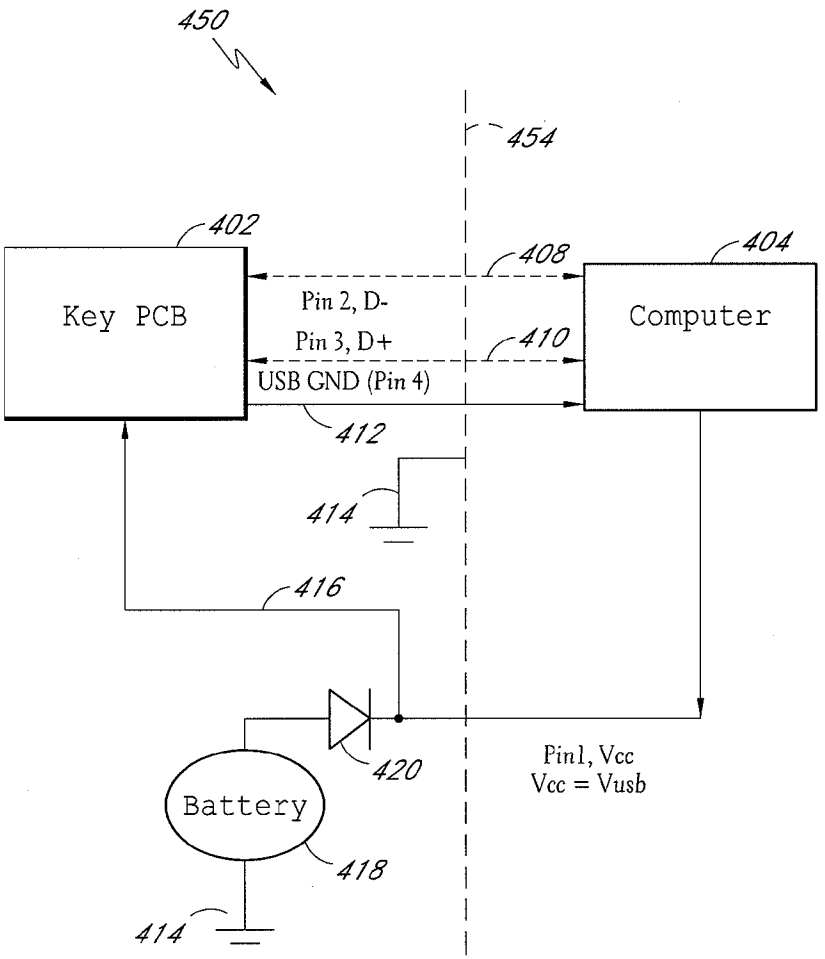
FIG. 4B is a block diagram of an embodiment of a computer connected to an electronic key that uses a connector as a switch.
Figure 4A:
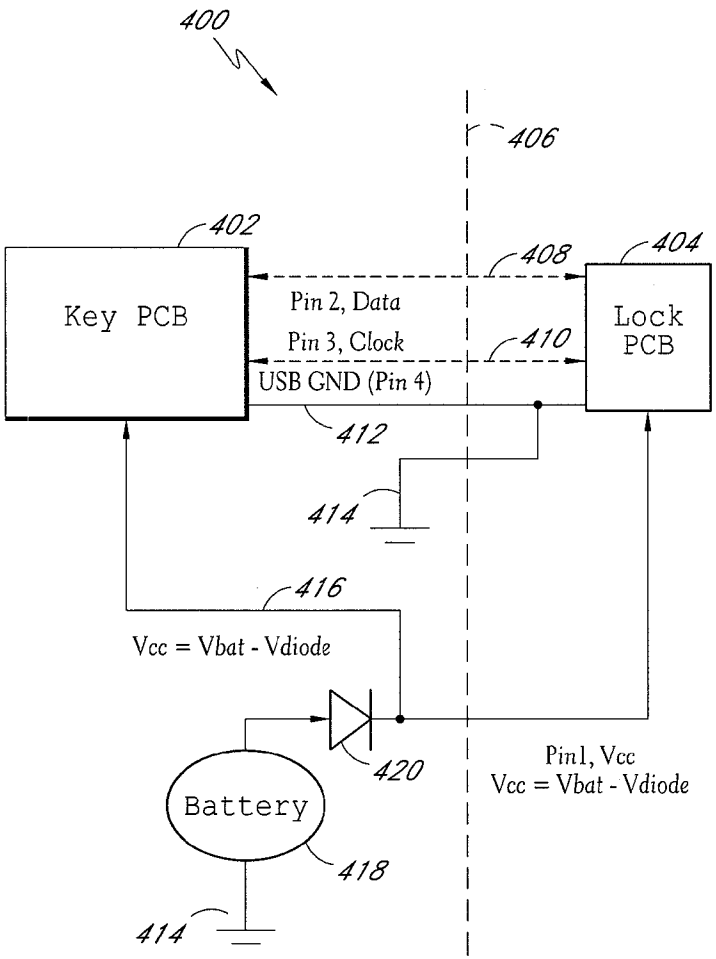
FIG. 4A is a block diagram of an embodiment of an electronic lock connected to an electronic key that uses a connector as a switch.

FIG. 4A is a block diagram of an embodiment of an electronic lock and key system 400 in which the electronic key 402 uses a connection 406 between a lock 404 and the key 402 as a switch. The embodiment shown in FIG. 4A can be implemented in combination with features of the embodiment shown in FIG. 3. In some embodiments, Pin 4 of the USB connector of the key 402 is isolated from a ground, while Pin 4 of the USB connector of the lock 404 is connected to a chassis of the connector. Isolating Pin 4 from ground allows the connector of the key to act like a switch when it is plugged in to the connector of the lock. When the key connector is inserted into the lock connector, the chassis of the key and the chassis of the lock form an electrical connection 412. The electrical connection 412 provides a ground 414 to the circuit, enabling the battery 418 to power the lock and key system 400. In some embodiments, the ground loop connection is completed by a trace on a circuit board of the lock that connects the ground pin 412 of the USB connector to the chassis of the connector. A diode 420 allows electrical energy to flow from the battery 418 to the key 402 and the lock 404. A data pin 408 and a clock pin 410 provide for communication between the key 402 and the lock 404.

FIG. 4B is a block diagram of an embodiment of an electronic key and computer system 450 that uses a connector as a switch. In the embodiment shown in FIG. 4B, an electronic key 402 has the same structure as the electronic key 402 described with respect to FIG. 4A. However, when the key 402 is connected to a powered USB port of a computer 404, electrical energy and a ground connection are supplied by the computer 404 to the key 402 because the diode 420 is open or "off". Power from the battery 418 is not used because the battery 418 is isolated from the rest of the circuit by the diode 420. In some embodiments, when the electronic key is not plugged into anything, the negative terminal of the battery 418 has no path to ground because the chassis of the USB connector of the key is isolated from the ground pin 412. Consequently, energy from the battery 418 is not used when the key 402 is not plugged in to the lock 404.

Figure 5:
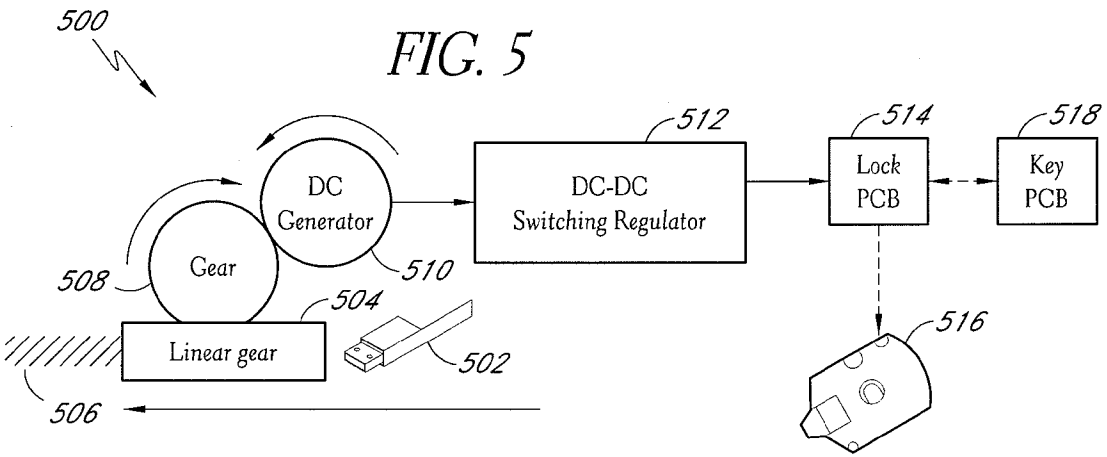
FIG. 5 illustrates an embodiment of an electronic lock and key system configured to convert translational mechanical energy to electrical energy.

FIG. 5 illustrates an embodiment of an electronic lock and key system 500 configured to convert translational movement into electrical energy. In the embodiment shown in FIG. 5, a key 502 pushes a linear gear 504 disposed in a lock in order to turn a generator 510. In some embodiments, the gear 504 incorporates a mechanical linkage 508 to the generator 510 that includes a reciprocating linear gear. The generator 510 can be any suitable generator for producing electrical energy, such as a DC generator. In some embodiments, the generator 510 can be an AC generator or an AC generator coupled to a rectifying circuit. The linear gear 504 can be connected to a spring 506 that exerts a force that causes translational movement of the linear gear when the spring is moved out of an equilibrium state. In some embodiments, a switching regulator 512 is disposed between the generator 510 and a printed circuit board (PCB) of the lock 514. The switching regulator 512 can be, for example, a DC-DC buck boost switching regulator with a suitably large capacitor or another type of switching regulator suitable to convert the generator 510 output into a form usable by the lock PCB 514. The lock PCB 514 can include electrical connections to provide power to a latch 516 and/or to a key PCB 518. The latch 516 can include a low power piezoelectric actuator or another style of actuator capable of operating with a relatively small level of energy input.

Figure 6:
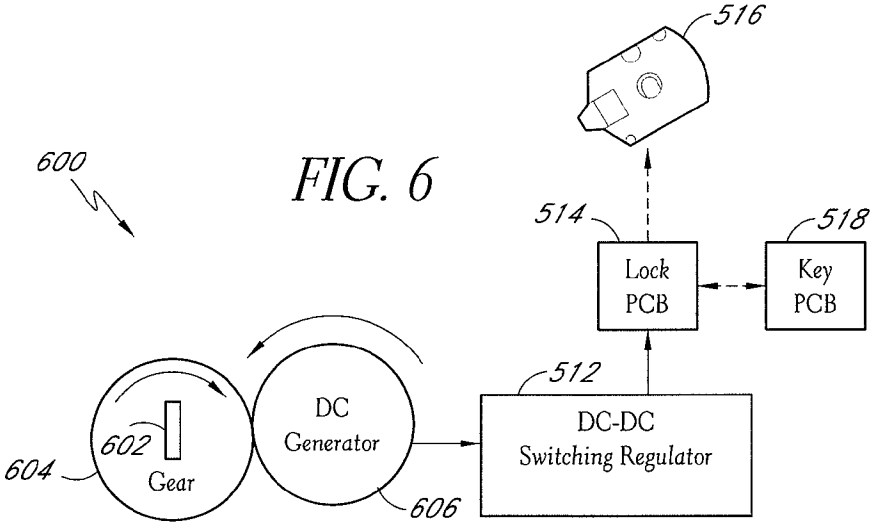
FIG. 6 illustrates another embodiment of an electronic lock and key system configured to convert rotational mechanical energy to electrical energy.

FIG. 6 illustrates another embodiment of an electronic lock and key system 600 configured to convert rotational mechanical energy to electrical energy. In the embodiment shown in FIG. 6, a key aperture 602 (for example, a key hole) is situated substantially coaxially with respect to a gear 604 with a lock. The key aperture 602 can be disposed on a door knob, for example. When an electronic key is inserted into the aperture 602, rotation of the key (for example, when torque is applied to the key by a user) causes the gear 604 to turn a generator 606. As described previously, a switching regulator 512 is disposed between the generator 606 and the lock PCB 514. The generator 606 and/or switching regulator 512 can include one of the configurations described with respect to FIG. 5 or another suitable configuration. Furthermore, the mechanical configuration described with respect to FIG. 5 can be combined with the features shown in FIG. 6 to create a lock capable of converting both translational movement and rotational movement of the key into electrical energy.

The lock PCB 514 and/or the key PCB 518 shown in FIGS. 5 and 6 can be configured to include at least some of the components or features of the circuits shown in FIGS. 3A, 3B, 4A, and 4B. Thus, the access control systems that include a lock with a generator can also include, for example, a key with a rechargeable battery and/or a connector that serves as a switch. In some embodiments, an access control system 400 includes a battery 418 that supplies power to the system when the electric potential generated by a lock 404 is less than the difference between the electric potential of the battery 418 and the voltage drop across a diode 420 (FIG. 4A). If the electric potential (for example, the voltage) generated by the lock 404 increases, then the battery 418 in the key can automatically shut off. In some embodiments, an access control system includes a power supply system in which both a battery and an electric generator can contribute to powering at least some components of the access control system. In some embodiments, an access control system includes a power supply system in which the generator 606 can provide enough energy to operate the system 600 if the battery 418 in the key is dead. In some embodiments, the generator 606 can increase the probability that the access control system can be powered and operated in emergency situations.

Figure 7:
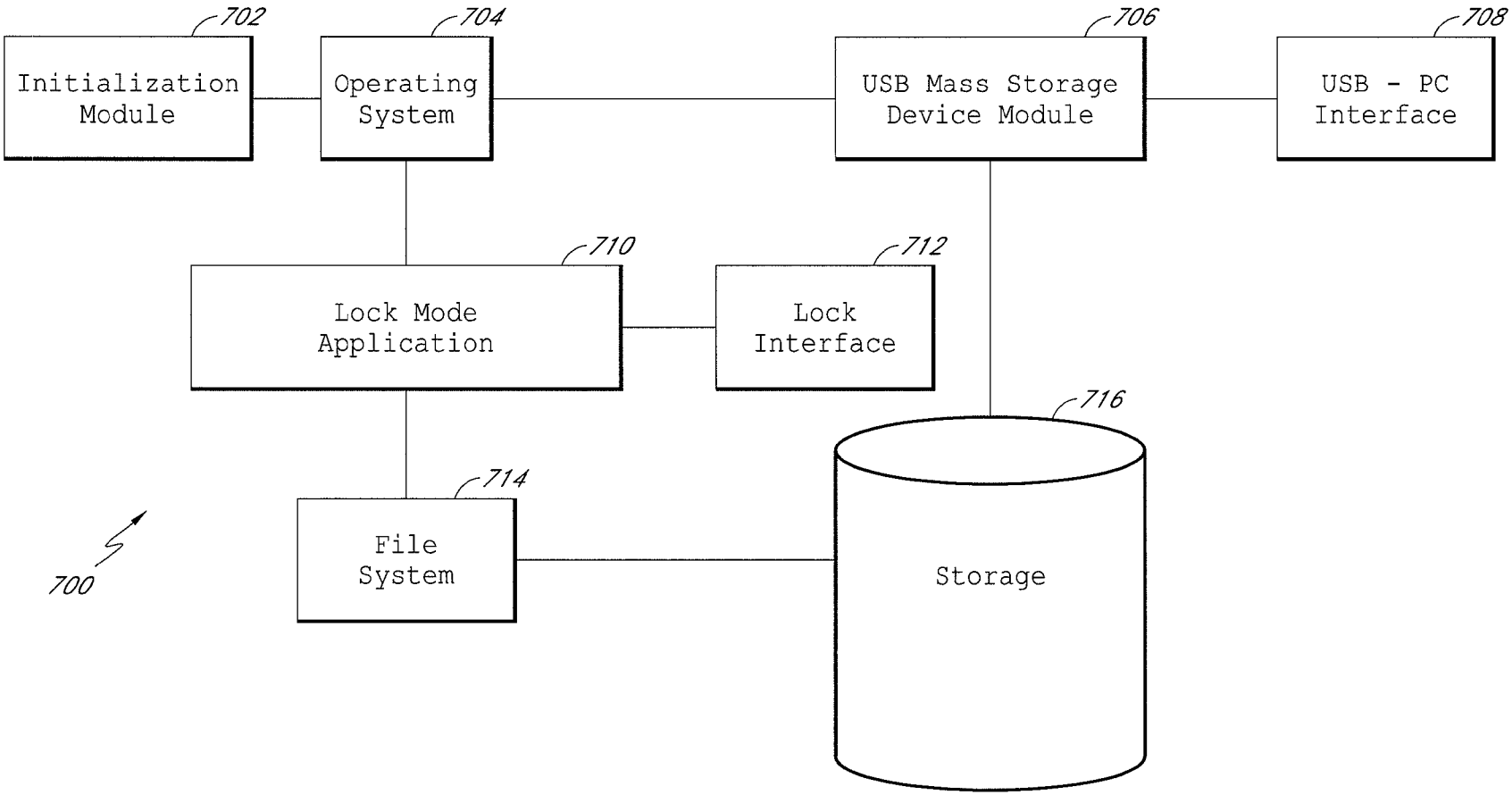
FIG. 7 is a block diagram of an embodiment of an electronic key configured to operate as a storage device for digital files.

FIG. 7 is a block diagram of an embodiment of an electronic key 700 configured to operate as a storage device for digital files. In some embodiments, the modules and program logic shown in FIG. 7 is embedded as firmware on, for example, the microcontroller of the key. The key 700 includes an initialization module 702 that contains program logic for booting up the key and preparing the hardware of the key to run an operating system 704. In some embodiments, the operating system 704 is a custom operating system that includes program logic for determining when the key is plugged into an electronic lock or a powered USB port of, for example, a computer system.

If it is determined that the key is plugged into a lock, the operating system 704 runs a lock mode application 710. The lock mode application includes program logic for handling communications with a lock interface 712 and with a file system 714. For example, if the lock mode application 710 determines, via the lock interface 712, that a lock includes outdated key access information, the lock mode application 710 can use the file system 714 to obtain updated key access information from a storage device 716. The file system 714 can implement, for example, FAT, FAT32, NTFS, UFS, Ext2, HFS, HFS Plus, or another suitable file system implementation. The lock mode application can also be configured to access information from a second key memory embedded in the microcontroller of the key, for example.

If it is determined that the key is plugged into a computer system, the operating system 704 loads a USB Mass Storage Device module 706 (a "USB storage module"). The USB Mass Storage Device protocol, created by the USB Implementers Forum, allows the storage 716 to be accessed directly by an operating system on a computer. The operating system 704 communicates with a computer system via the USB storage module 706 and a USB-PC interface 708. The modules and program logic on the electronic key allow it to operate as both an access control device and as a USB storage device.

Figure 8:
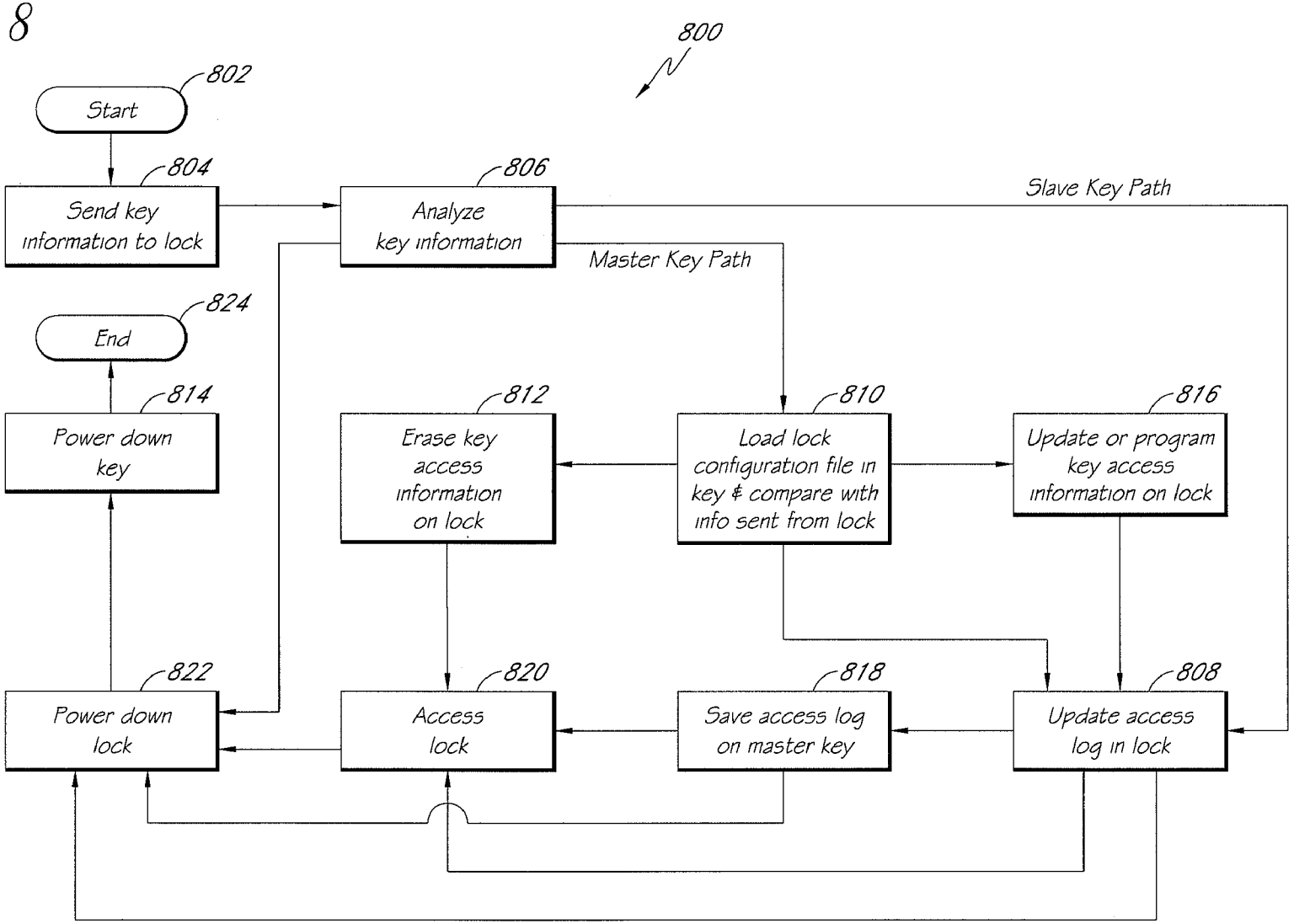
FIG. 8 is a flowchart of an embodiment of a method of operation of an electronic access control system.

FIG. 8 illustrates an example embodiment of a method 800 for operating an electronic lock and key system. The method 800 begins by executing instructions to boot up the electronic key (802). During the boot up stage, the key can optionally perform a biometric read of a user of the key in order to confirm that the user is authorized. When the key is inserted into a lock, the key sends key information to the lock (804). The key information can include, for example, a public identifier, a private identifier of the key. Next, the lock analyzes the key information in order to determine what action to perform (806). The analysis includes determining whether the key information matches key access information stored in the lock. For example, if the public and private identifiers of the key are found in the lock's key access information, the lock proceeds to update an access log (808).

The analysis (806) can also include determining whether the lock's key access information is expired or if the key has administrative privileges. In some embodiments, if the key access information in the lock is expired and if the key has administrative privileges, the lock sends lock information (such as, for example, a lock identifier) to the key. In response, the key can load the lock's new key access information by using the lock identifier to search for the lock configuration file stored in the keys memory. For example, the name of the lock configuration file can include the lock identifier.

The key compares the lock's key access information revision date with a key access information revision date stored in the key's lock configuration file (810). By comparing the dates instead of comparing the key access information in the lock with the key access information in the lock configuration file, the key can save energy, hasten access to the lock, and hasten reprogramming. If the key access information needs to be updated, or if the lock does not have key access information, the key instructs the lock to update or program the key access information in the lock (816). The lock may also read and store the private identifier of the key. After the key access information is updated or programmed, the lock proceeds to update an access log (808). If the key access information in the lock configuration file is not revised (for example, if the key access information in the lock configuration file matches the key access information stored in the lock's memory), the lock proceeds directly to update an access log (808). If the key does not have a lock configuration file for the lock it is plugged into, the lock can be configured to treat the key as slave key and update the access log (808) without making any updates to the lock's key access information (KAI).

If the master key loads the lock configuration file (810) and determines that the KAI in the lock configuration file has no key users (for example, if the file shows that no keys have access privileges), then the master key can send a signal to the lock to erase its KAI (812). The analysis (806) can also include determining whether a key is accessing the lock for the first time. If it is the first access for the key, then the lock updates the key's private identifier in the lock memory's KAI. If the lock erases its key access information (812), then the lock proceeds to grant access (820) and then power down the lock (822).

In some embodiments, the lock and/or the key maintains an access log. If the lock does not have an access log, and if the key access information is successfully updated or programmed, then the lock proceeds to access the lock (820) by, for example, actuating a latch. If the lock does maintain an access log, then the lock can send an access log to the key for storage as an access log file (818) before proceeding to access the lock (820). If the key information does not match the key access information, or if the lock does not successfully update or program its key access information and there is no access log, or if the access log is not successfully updated, then the lock proceeds to power down (822) without granting access. The lock also powers down (822) after a successful access (820). After the lock powers down, the key powers down and leaves the lock mode (814). The process ends when the key is removed from the lock (824).

Figure 9:
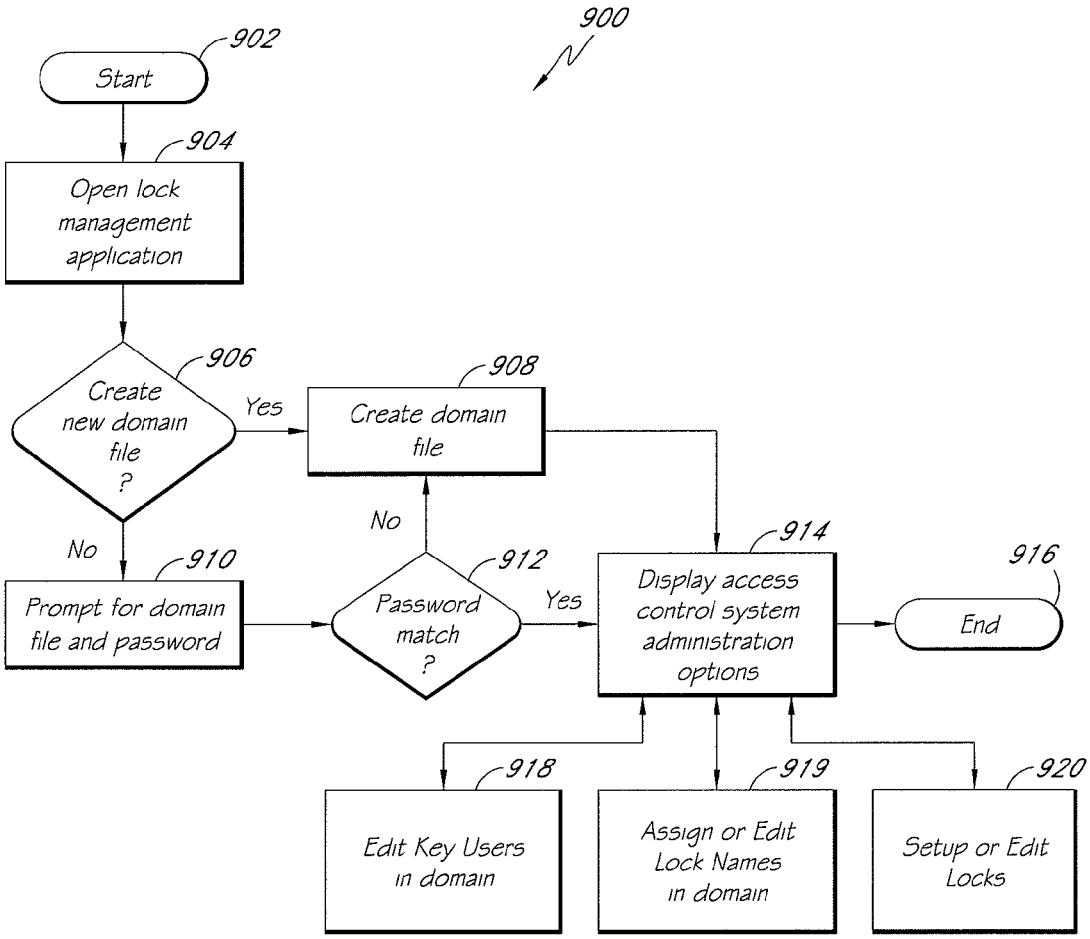
FIG. 9 is a flowchart of an embodiment of a method for configuring key access information in an access control system.

FIG. 9 is a flowchart of an embodiment of a method 900 for configuring key access information in an access control system. In some embodiments, the method 900 begins when a user inserts a key into a USB port of a computer system (902). Next, an access control system management application (or admin application) is opened, either automatically upon insertion of the key or upon an action of the user (904). The admin application determines whether a new domain file needs to be created (906). For example, the admin application may determine whether a domain file is stored on the key or may prompt the user to determine whether she will be creating a new domain. If a new domain file will be created, the admin application proceeds to create a new domain file (908). The domain file links lock configuration files, which contain key access information for individual locks, to alias names of the locks and links keys to alias key user names, which are interpreted by the admin application.

If a new domain file will not be created, the admin application attempts to open a domain file from the computer or from the key (910). In some embodiments, the admin application prompts the user to locate a domain file. The admin application may also search for one or more domain files in a location on the computer or on the key. The admin application may prompt the user to enter a password associated with the domain file, if any (912). If the password does not match, then the admin application can default to creating a new domain file (908). After creating a domain file or getting a password match, the admin application displays administration options for an access control system (914) and receives input from the user indicating what changes should be made to the domain file and/or lock configuration files. The changes can include, for example, assigning or editing locks in the domain (919), editing keys (such as, for example, slave keys or master keys) or key users in the domain (918) and other domain-specific key access information such as linking a public key identifier to a key user's alias name (918) and a lock identifier to a lock's alias name (919). In some embodiments, the domain file is a file that enables the admin application to manage and to link the lock configuration files for each lock (920). The lock configuration files contain key access information for each lock that determines what keys have access privileges for locks in the domain. Lock configuration files can also be used by the master key to program locks. In some embodiments, the access log is a separate file that can store the number of accesses, time of access, date of access, and optionally other access data. The access log can be stored in a memory of a lock and can be transferred to a file on a master key when the master key accesses the lock. Changes are written to the domain file and lock configuration files, and the process 900 ends when the domain file and/or lock configuration files are closed (916).

FIG. 10 illustrates an example embodiment of an interface 1000 for configuring key access information in a domain file. The interface 1000 includes a keys portion 1002 that shows a list of keys in a domain. A user can identify the keys by a key alias, by a public identifier (Key_ID#), or by key type (master or slave). The keys portion 1002 includes interface elements for adding keys to the domain, removing keys from the domain, changing the key type, and/or other functionality.

The interface 1000 also includes a locks portion 1004 that shows a list of locks in the domain. A user can identify locks by a lock alias, by a lock identifier, or, optionally, by other lock properties. In some embodiments, the locks portion 1004 includes interface elements for viewing lock access logs, adding locks to the domain, removing locks from the domain, changing a lock alias, and/or other functionality.

The interface 1000 includes lock configuration file portions 1006, 1008 that show a list of keys that have access privileges for locks in the domain. The lock configuration file portions 1006, 1008 provide interface elements that allow a user to create and/or modify lock configuration files containing key access information for individual locks. The lock associated with each lock configuration file portion can be identified by lock identifier and/or lock alias. Each portion 1006, 1008 identifies keys that have access privileges for a lock by key alias, key type, other identifiers, and/or other lock configuration file properties. In some embodiments, the lock configuration file portions 1006, 1008 include interface elements for deleting key access privileges, adding key access privileges, updating a lock configuration file, and/or other functionality. Interface elements can include buttons, hyperlinked text, selection lists, pull-down menus, check boxes, text input boxes, radio buttons, etc.

It is recognized that the term "module" may include software that is independently executable or standalone. A module can also include program code that is not independently executable. For example, a program code module may form at least a portion of an application program, at least a portion of a linked library, at least a portion of a software component, or at least a portion of a software service. Thus, a module may not be standalone but may depend on external program code or data in the course of typical operation.

Although systems and methods of electronic access control are disclosed with reference to preferred embodiments, other embodiments will be apparent to those of ordinary skill in the art from the disclosure herein. Moreover, the described embodiments have been presented by way of example only, and are not intended to limit the scope of the inventions. Rather, a skilled artisan will recognize from the disclosure herein a wide number of alternatives for the exact ordering the steps, how an electronic key is implemented, how an electronic lock is implemented, or how an admin application is implemented. Other arrangements, configurations, and combinations of the embodiments disclosed herein will be apparent to a skilled artisan in view of the disclosure herein and are within the spirit and scope of the inventions as defined by the claims and their equivalents.

What is claimed is:

1. A rechargeable electronic key for use with an electronic lock, the electronic key comprising:

a memory device;

a private identifier for the electronic key stored in the memory device, the private identifier being accessible to the electronic lock but not readily accessible to a user of the electronic key;

a public identifier for the electronic key that is readily accessible to a user of the electronic key, the public identifier configured to identify the electronic key to the electronic lock and to the user of the electronic key;

a key controller configured to electrically connect to a lock controller associated with the electronic lock;

a power management circuit configured to electrically connect to a power source; and a rechargeable battery;

wherein the power management circuit is configured to supply energy from the rechargeable battery to other components of the electronic key, to supply energy from the rechargeable battery to the electronic lock when the electronic key is engaged with the electronic lock, and to recharge the rechargeable battery when the power management circuit is connected to the power source.

2. The electronic key of claim 1, further comprising:

a power path electrically connected to the rechargeable battery, the power path being configured to electrically connect to a powered bus connector; and a data path electrically connected to the key controller, the data path being configured to electrically connect to a data bus associated with the electronic lock.

3. The electronic key of claim 2, wherein the power path and the data path share an external connector disposed on the electronic key.

4. The electronic key of claim 3, wherein the external connector comprises a Universal Serial Bus (USB) connector.

5. The electronic key of claim 1, further comprising a detection circuit for determining when a power connector of the electronic key is connected to a powered bus that provides more than a threshold electric potential, wherein the detection circuit outputs a signal that is communicated to the key controller to cause the key controller to enable a battery charger to charge the rechargeable battery when the powered bus provides more than the threshold electric potential.

6. An electronic access control system having switchable power states comprising:

an electronic key comprising:

a key housing;

a first connector disposed on the key housing, the connector having a key power supply pin and a key ground pin, and the first connector being configured to electrically connect to a digital bus associated with an electronic lock;

a private identifier for the electronic key, the private identifier being accessible to the electronic lock but not readily accessible to a user of the electronic key;

a public identifier for the electronic key that is readily accessible to a user of the electronic key, the public identifier configured to identify the electronic key to the electronic lock and to the user of the electronic key;

a microcontroller;

a battery;

a switching device connected between the battery and the power supply pin of the first connector and configured to allow energy to flow from the battery to the power supply pin of the first connector when the electric potential on the first connector side of switching device is less than the electric potential on the battery side of the switching device.

7. The electronic access control system of claim 6, wherein the switching device comprises a diode.

8. An electronic access control system having switchable power states comprising:

an electronic key comprising:

a key housing;

a first connector disposed on the key housing, the connector having a key power supply pin and a key ground pin, and the first connector being configured to electrically connect to a digital bus associated with the electronic lock;

a microcontroller;

a battery; and a switching device connected between the battery and the power supply pin of the first connector and configured to allow energy to flow from the battery to the power supply pin of the first connector when the electric potential on the first connector side of switching device is less than the electric potential on the battery side of the switching device;

and an electronic lock comprising:

a lock chassis;

a lock controller; and a second connector having a lock ground pin, the lock ground pin being electrically connected to the lock chassis, the second connector being configured to electrically connect to the first connector;

wherein the key ground pin is isolated from ground when the first connector is not connected to the second connector; and wherein the key ground pin connects to the lock chassis, and the battery of the electronic key supplies electrical energy to the electronic access control system, when the first connector is connected to the second connector.

9. The electronic access control system of claim 6, wherein the first connector comprises a USB connector.

10. An electronic lock that generates electrical energy comprising:

a lock memory;

key access information stored in the lock memory, the key access information comprising a public identifier and a private identifier associated with an electronic key, wherein the public identifier is readily accessible to a user of the electronic key and to the electronic lock, and wherein the private identifier is accessible to the electronic lock but is not readily accessible to a user of the electronic key;

a key connector having a power supply pin;

a generator configured to be driven by movement of an electronic key when the electronic key is used in the key connector;

a lock circuit; and a latch electrically connected to the lock circuit, the latch being configured to actuate between a locked state and an unlocked state when an identifier associated with the electronic key is present in the key access information stored in the lock memory;

wherein the generator is configured to at least partially power at least one of the lock circuit and the electronic key.

11. The electronic lock of claim 10, wherein the generator is linked to a linear gear, wherein insertion of the electronic key into the key connector causes translational movement of the linear gear, and wherein translational movement of the linear gear causes the generator to produce electrical energy.

12. The electronic lock of claim 11, further comprising a spring connected to the linear gear, wherein the spring exerts a force that causes translational movement of the linear gear after the spring is moved out of an equilibrium state.

13. The electronic lock of claim 10, wherein the latch comprises a piezoelectric latch.

14. The electronic lock of claim 10, wherein the key connector comprises an elongate dimension that is situated coaxially with respect to a gear, and wherein a mechanical linkage between the key connector and the gear causes the generator to generate electrical energy when torque is applied to a housing of the electronic key.

15. An electronic lock that generates electrical energy comprising:

a lock memory;

key access information stored in the lock memory;

a key connector having a power supply pin;

a generator configured to be driven by movement of an electronic key when the electronic key is used in the key connector;

a lock circuit; and a latch electrically connected to the lock circuit, the latch being configured to actuate between a locked state and an unlocked state when an identifier associated with the electronic key is present in the key access information stored in the lock memory; and a linkage between the key connector and the generator, the linkage being configured such that the generator converts at least portions of both translational movement of the electronic key and rotational movement of the electronic key into electrical energy;

wherein the generator is configured to at least partially power at least one of the lock circuit and the electronic key.

16. An electronic key for use with an electronic lock and for storing digital files comprising:

a key memory;

a private identifier for the electronic key, the private identifier being accessible to the electronic lock but not readily accessible to the user of the electronic key;

a public identifier for the electronic key that is readily accessible to a user of the electronic key, the public identifier configured to identify the electronic key to the electronic lock and to the user of the electronic key;

a digital bus connector, the digital bus connector being configured to electrically connect to a digital bus associated with the electronic lock, and the digital bus connector being configured to electrically connect to a digital bus associated with a computer system having a microprocessor, a main memory, and an operating system; and a microcontroller configured to allow the computer system to access the key memory as a mass storage device.

17. The electronic key of claim 16, wherein the microcontroller implements a file system on the key memory selected from the group consisting of FAT, FAT32, NTFS, UFS, Ext2, HFS, and HFS Plus.

18. The electronic key of claim 16, wherein the electronic key is configured to allow the computer system to access the key memory device using the USB Mass Storage Device specification.

19. The electronic key of claim 16, wherein the electronic key comprises a socket for a removable solid state non-volatile memory device.

20. An electronic access control system with a streamlined user interface comprising:

an electronic lock comprising:

a lock memory configured to store key access information;

a lock identifier;

a lock controller comprising program code for comparing a key identifier to the key access information stored in the lock memory; and a lock bus connector;

a first electronic key comprising:

a first memory device;

a lock configuration file comprising key access information for configuring the electronic lock;

a first private identifier for the first electronic key, the first private identifier being accessible to the lock controller but not readily accessible to a user of the first electronic key;

a first key controller comprising program code for providing key access information to the electronic lock when first predetermined criteria are met, program code for accessing the electronic lock when second predetermined criteria are met, and program code for erasing the electronic lock when third predetermined criteria are met; and a first digital bus connector configured to electrically connect to the lock bus connector; and a second electronic key comprising:

a second memory device;

a second private identifier for the second electronic key, the second private identifier being accessible to the lock controller but not readily accessible to a user of the second electronic key;

a second key controller comprising program code for accessing the electronic lock without user input when fourth predetermined criteria are met; and a second digital bus connector configured to electrically connect to the lock bus connector.

21. The electronic access control system of claim 20, wherein the lock memory and the lock controller are contained on a single integrated circuit.

22. The electronic access control system of claim 20, wherein the first predetermined criteria further comprise at least one of whether a date associated with a lock configuration file stored on the electronic key is more recent than a date associated with the key access information stored in the electronic lock or whether the electronic key has privileges to update locks in a domain of the electronic lock.

23. The electronic access control system of claim 20, wherein the second predetermined criteria comprise whether the key access information stored in the electronic lock includes the private identifier of the electronic key.

24. The electronic access control system of claim 20, wherein the third predetermined criteria comprise at least one of whether the electronic key has privileges to erase the key access information from the electronic lock or whether the key access information in the lock configuration file shows that no keys have access privileges for the electronic lock.

25. The electronic access control system of claim 20, wherein the fourth predetermined criteria comprise whether the key access information stored in the electronic lock includes the private identifier of the electronic key.

26. The electronic key of claim 1, wherein the key controller comprises program code for providing key access information to the electronic lock when first predetermined criteria are met, program code for accessing the electronic lock when second predetermined criteria are met, and program code for erasing the electronic lock when third predetermined criteria are met.

27. The electronic key of claim 1, wherein the key controller comprises program code for providing the private identifier to the lock controller when the public identifier of the electronic key is present in a lock configuration file associated with the electronic lock.

* * * * *